US007509760B2

(12) United States Patent
Beall

(10) Patent No.: US 7,509,760 B2
(45) Date of Patent: Mar. 31, 2009

(54) MONEY DISPLAY VAULT AND METHOD THEREFOR

(76) Inventor: Weldon L. Beall, 2121 W. Northview, Phoenix, AZ (US) 85021

( * ) Notice: Subject to any disclaimer, the term of this patent is extended or adjusted under 35 U.S.C. 154(b) by 0 days.

(21) Appl. No.: 11/780,007

(22) Filed: Jul. 19, 2007

(65) Prior Publication Data

US 2008/0017084 A1 Jan. 24, 2008

Related U.S. Application Data

(60) Provisional application No. 60/807,962, filed on Jul. 21, 2006.

(51) Int. Cl.
*G09F 19/00* (2006.01)

(52) U.S. Cl. ..... 40/406; 406/112; 454/195; 472/137

(58) Field of Classification Search ..... 454/195; 109/46, 49.5, 55; 406/12, 109–112, 146, 406/155, 169

See application file for complete search history.

(56) References Cited

U.S. PATENT DOCUMENTS

| | | | | |
|---|---|---|---|---|
| 3,930,452 | A * | 1/1976 | Van Laethem et al. | 109/80 |
| 4,315,704 | A * | 2/1982 | Kelley et al. | 406/12 |
| 4,725,256 | A | 2/1988 | Sassak | |
| 5,299,891 | A * | 4/1994 | Grosswiller et al. | 406/112 |
| 6,722,887 | B2 * | 4/2004 | Polonio | 434/237 |

OTHER PUBLICATIONS

Fun Industries Inc., Elite Hollywood Money Machine, Apr. 8, 2005, Monte Carlo Money Machine□□http://web.archive.org/web/20050408075429/www.funindustries.com/elite-hollywood-money-machine.htm.*

* cited by examiner

*Primary Examiner*—Paul N Dickson
*Assistant Examiner*—Shin Kim
(74) *Attorney, Agent, or Firm*—Jeffrey D. Moy; Weiss & Moy, P.C.

(57) ABSTRACT

A money display vault has at least one of a transparent tube display and a transparent chamber display to allow cash reserves of an establishment to be displayed to the public, yet remained secured from possible theft. A device is coupled to the at least one of a transparent tube display and a transparent chamber display to move the money around the at least one of a transparent tube display and a transparent chamber display.

20 Claims, 5 Drawing Sheets

MONEY DISPLAY VAULT AND METHOD THEREFOR

RELATED APPLICATIONS

This application is related to U.S. Provisional Application Ser. No. 60/807,962 filed Jul. 21, 2006, in the name of the same inventor listed above, and entitled, "DISPLAYABLE MONEY VAULT FOR A CASINO".

FIELD OF THE INVENTION

This invention relates to a vault and, more specifically, to a money display vault that allows a casino, bank, or the like to display full, faith and credit money to the public.

BACKGROUND OF THE INVENTION

When gambling in a casino, a customer generally will give currency to a casino teller. In return, the casino teller will give the customer casino chip(s) in the value of the currency received. The casino chips are generally made of wood or plastic and have an assigned monetary value printed thereon. The casino chips are then used by the customer to gamble in the affiliated casino. Outside of the affiliated casino, the casino chips generally have no monetary value.

Casinos are required by law to keep a predetermined amount of cash in a vault of the casino. The money must stay in the vault and cannot be used by the casino. The amount of cash stored in the vault by the casino is based on the total monetary value of the casino chips. In general, the cash is stored in the vault with access to the vault limited to high level casino employees. Since the money is stored in the vault, the casino has no way to display the money or profit from the stored money.

Therefore, a need existed to provide a device and method to overcome the above problem.

SUMMARY OF THE INVENTION

In accordance with one embodiment of the present invention, a money display vault is disclosed. The money display vault has at least one of a transparent tube display and a transparent chamber display to allow cash reserves of an establishment to be displayed to the public, yet remained secured from possible theft. A device is coupled to the at least one of a transparent tube display and a transparent chamber display to move the money around the at least one of a transparent tube display and a transparent chamber display.

In accordance with another embodiment of the present invention, a money display vault is disclosed. The money display vault has a transparent tube display to allow cash reserves of an establishment to be displayed to the public, yet remained secured from possible theft. A transparent chamber display is also provided to allow cash reserves of an establishment to be displayed to the public, yet remained secured from possible theft. A device is coupled to the transparent tube display and the transparent chamber display to move the money around the at least one of a transparent tube display and a transparent chamber display. The transparent tube display and the transparent chamber display are formed of a bullet/shatter proof clear material.

In accordance with another embodiment of the present invention, a money display vault is disclosed. The money display vault has a transparent tube display to allow cash reserves of an establishment to be displayed to the public, yet remained secured from possible theft. The transparent tube display has a plurality of transparent tubular members fit together to form a pathway around the establishment. At least one tube opening is formed in the transparent tube display to allow access to an interior of the transparent tube display to insert and remove money from the transparent tube display. A tube blowing mechanism is coupled to the transparent tube display to move the money through the transparent tube display. A transparent chamber display is also provided to allow cash reserves of an establishment to be displayed to the public, yet remained secured from possible theft. The transparent chamber display has a hollow transparent enclosure. A door is hingedly coupled to the hollow transparent enclosure to allow a person to go into an interior section of the hollow transparent enclosure. At least one chamber opening is formed in the hollow transparent enclosure to allow access to an interior of the transparent tube display to insert and remove money from the hollow transparent enclosure. A chamber blowing mechanism is coupled to the hollow transparent enclosure to move the money within the hollow transparent enclosure. The transparent tube display and the transparent chamber display are formed of a bullet/shatter proof clear material.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
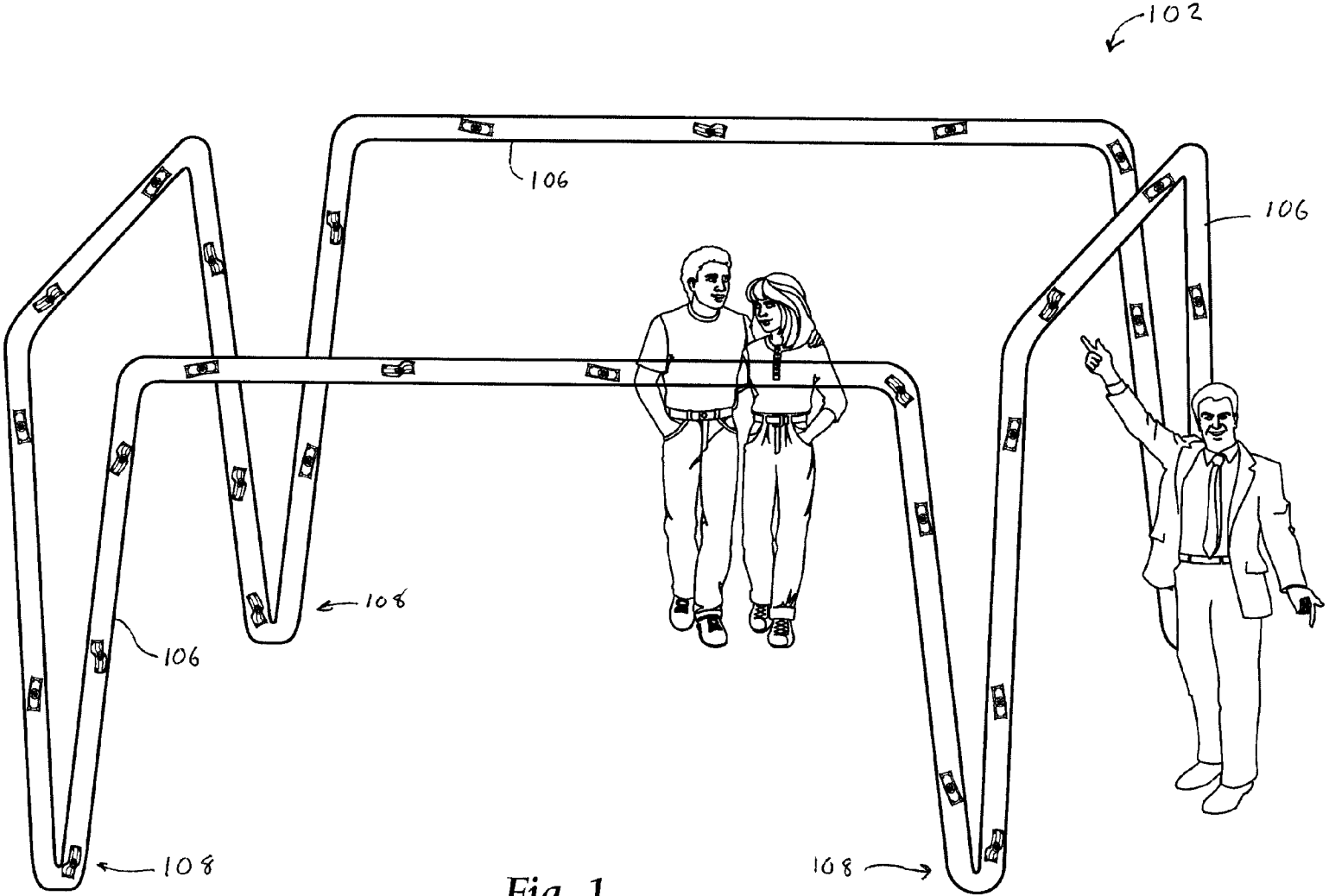
FIG. 1 is a perspective view of a tube display system forming a part of the present invention.
Figure 2:
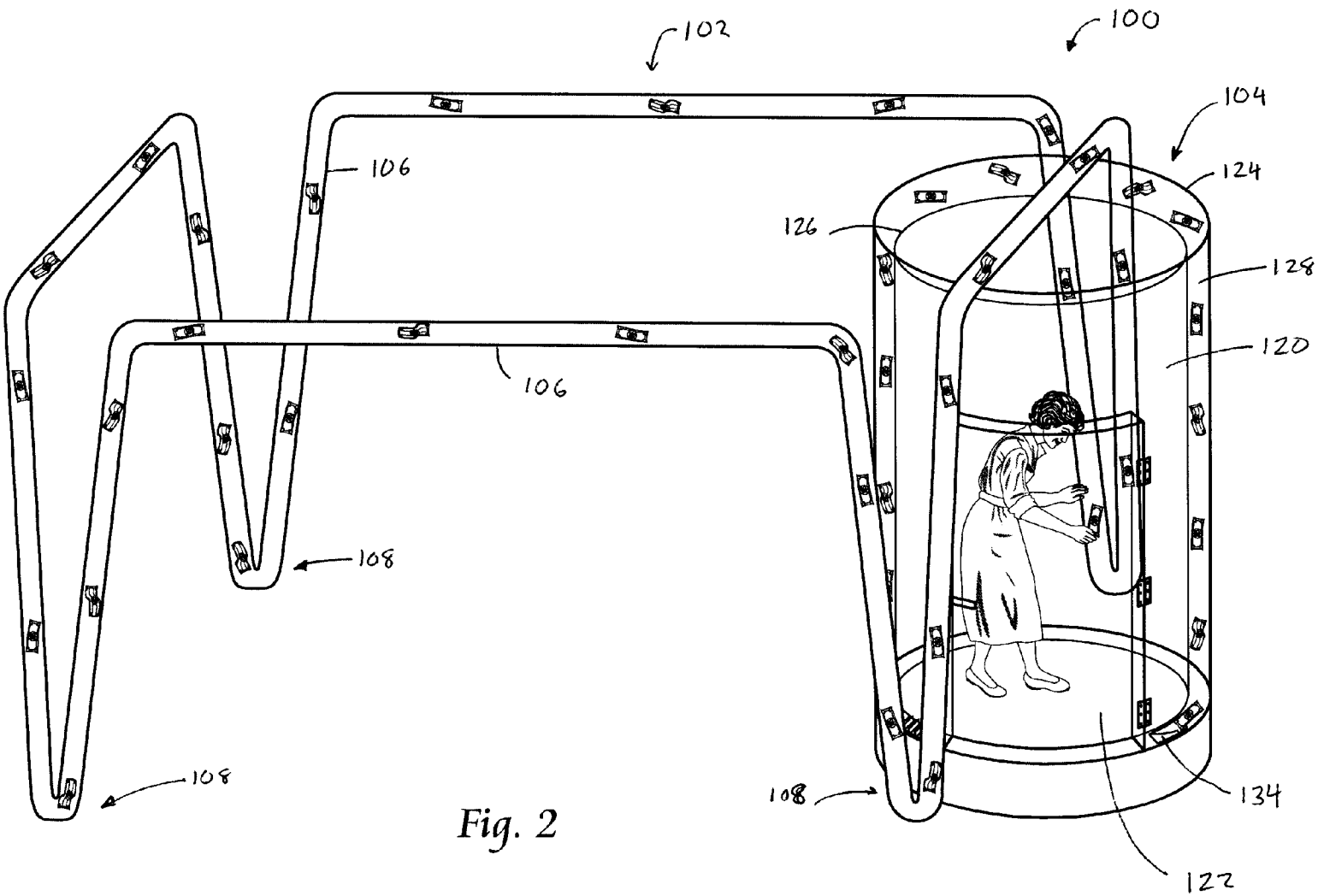
FIG. 2 is a perspective view of the tube display system and a display chamber of the present invention.
Figure 3:
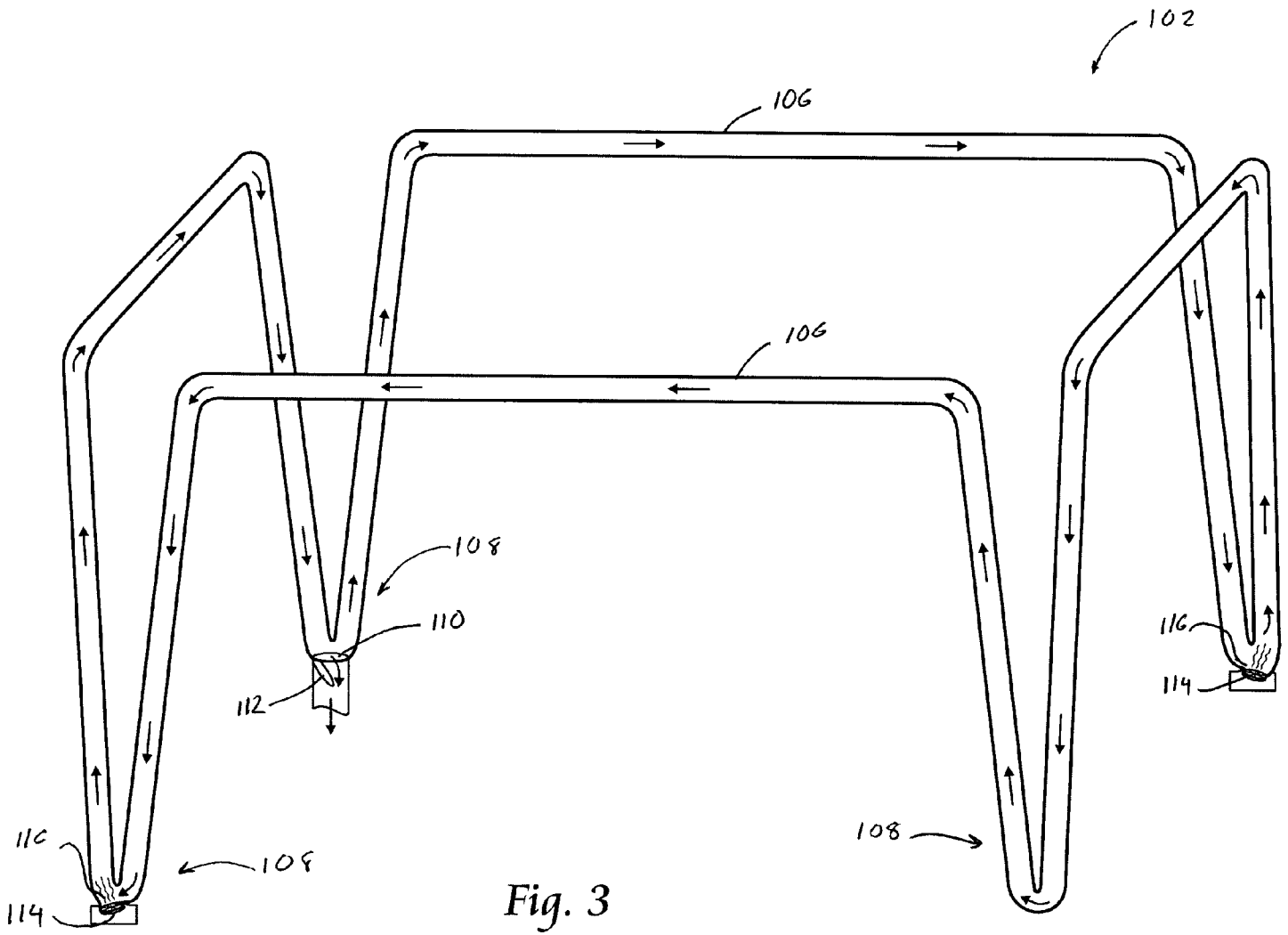
FIG. 3 is a perspective view of the tube display system showing a travel route of the money.
Figure 5:
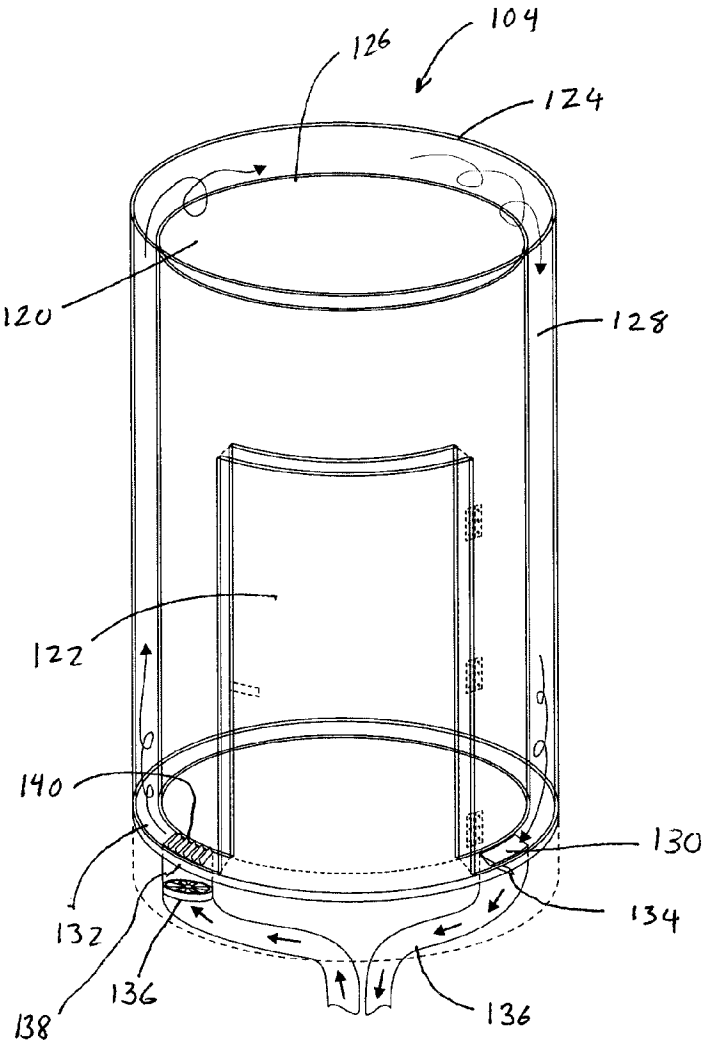
FIG. 5 is a perspective view showing the display chamber and the fan system used in the display chamber.
Figure 4:
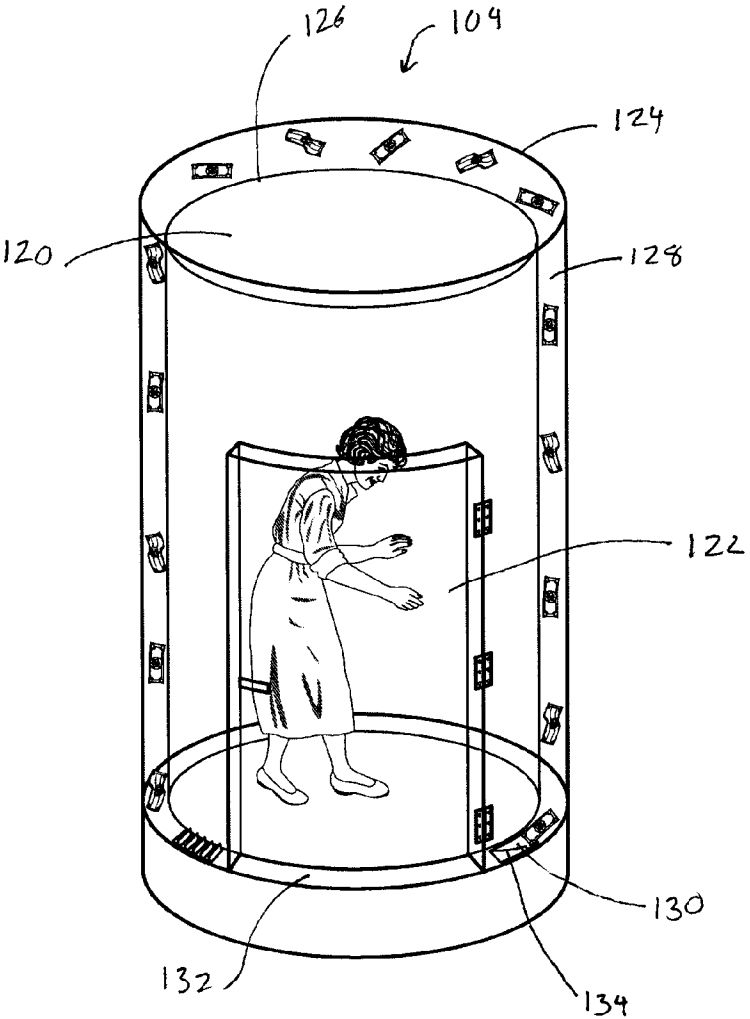
FIG. 4 is a perspective view of the display chamber showing money flowing around the chamber.
Figure 6:
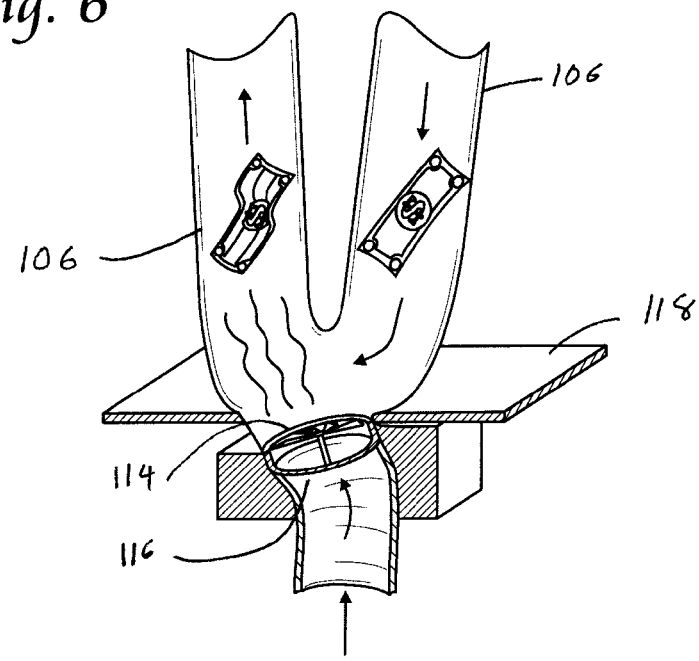
FIG. 6 is a magnified view of a fan system for the tube display system.
Figure 7:
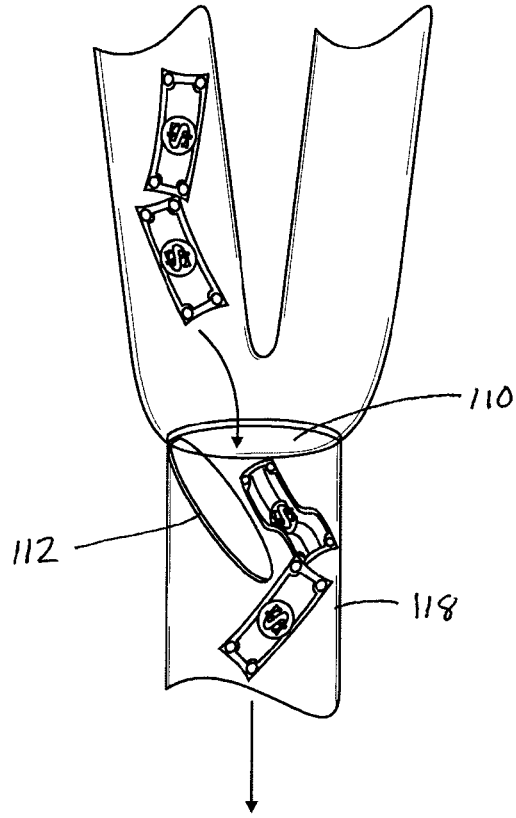
FIG. 7 is a magnified view showing a flap mechanism to remove the money from the tube display system.

With reference now to the Figures, a money display vault 100 (hereinafter vault 100) is shown. The vault 100 is comprised of two main display systems: a tube display 102 and a chamber display 104. Both the tube display 102 and a chamber display 104 will allow cash reserves of an establishment, such as a casino, to be displayed to the public, yet remained secured from possible theft. The casino may then charge people to view or step into the tube display 102 and/or chamber display 104. The tube display 102 and the chamber display 104 may be used together, or separately to display the cash reserves of an establishment.

The tube display 102 is comprised of a plurality of transparent tubes 106. Each tube 106 is generally formed of a bullet/shatter proof clear material. This will allow the cash reserves of the establishment to be displayed to the public, yet remained secured from possible theft. The material may be a durable and scratch resistant polycarbonate plastic that is the same material used on bullet-proof plastic may be used. Bullet proof glass may also be used.

The different tubes 106 will be fit together to form a pathway around the establishment. The pathway may be any size and configuration. In accordance with one embodiment as shown in the Figures, the tubes 106 are arranged to form a rectangular configuration. The rectangular configuration will have leg members 108 which will rest on a floor/platform 118 to support the tube display 102 in an upright position. However, this is just one example of a configuration of the tube display 102. Other configurations may be formed without departing from the spirit and scope of the present invention.

The tube display 102 will have at least one opening 110 formed in one of the tubes 106. In the embodiment shown in the Figures, the opening 110 is formed at the bottom of one of the legs 108. The opening 110 will generally have a movable flap 112 hinged to the opening 110. The flap 112 may be moved to open the tube display 102 to allow access to the interior of the tube display 102 and closed to prevent access to the interior of the tube display 102.

The flap 112 is generally opened to remove money from the tube display 102 or to insert money into the tube display 102. As shown in the Figures, once the flap 112 is opened to remove the money, the mechanisms used to move the money through the tube display 102 will cause the money to flow out of the opening 110 down a chute 118 to a secure location such as a secure room, a vault, or the like. When the flap 112 is opened to insert money, once the money is placed in the tube display 102, the flap 112 is closed. The money may then flow through the tube display 102. As shown in the Figures, in accordance with one embodiment, once the flap 112 is closed, a continuous loop is formed in the tube display 102. This will allow the money to continuously flow through the tube display 102 until the money is removed or the mechanism to move the money is stopped.

In order for the money to move through the tube display 102 some type of flow mechanism needs to be used. In accordance with one embodiment of the present invention, one or more blowers 114 are installed in the tube display 102. As shown in the Figures, one of more fan openings 116 is formed in the tube display 102. A blower 114 is then attached to the opening 116 to form a tight seal around the opening 116. The blower(s) 114 will provide enough wind velocity to continuously move the money through the tube display 102. The number of blowers 114 and the horsepower of the blowers 114 will depend on the size and shape of the tube display 102.

The chamber display 104 is comprises of a hollow transparent enclosure 120. In the Figures, the enclosure 120 is cylindrical in shape. However, this is just an example of one embodiment. The enclosure 120 may be any size and shape as long as it allows a person to be placed inside. The enclosure 120 is generally formed of a bullet/shatter proof clear material. This will allow the cash reserves of the establishment to be displayed to the public, yet remained secured from possible theft. The material may be a durable and scratch resistant polycarbonate plastic that is the same material used on bulletproof plastic may be used. Bullet proof glass may also be used.

The enclosure 120 will have a door 122. The door 122 is movably coupled to the enclosure 120. The door 122 will allow people to enter the interior of the enclosure 120.

The cash reserves may be displayed in multiple ways. In accordance with one embodiment, the money is placed in the interior of the enclosure 120. A mechanism is used to move the money all around the interior of the enclosure 120. An issue with this embodiment is that when a person enters the enclosure 120, the person may be able to steal some of the money. Secondly, the money being blown in the enclosure 120 may injure the person. These issues may be solved by having the person wear a designated jumpsuit before entering the enclosure 120. The jumpsuit would not have any pockets and would be designed so that the person would not be able to grab any of the money. The suit would further help diminish any injuries from the flying money. To further prevent injuries, the mechanism used to move the money may be controlled so that the will only blow up to a predefined height and at a predefined velocity.

In accordance with another embodiment as shown in the Figures, the enclosure 120 will have an outer wall 124 and an inner wall 126. A space 128 is formed between the outer wall 124 and an inner wall 126. The space 128 is a money flow area where the cash reserves of the establishment will be displayed to the public, yet remained secured from possible theft. The door 122 is also designed to have the outer wall 124 and the inner wall 126. This design will allow the money to flow freely around the space 128 of the enclosure 120.

An opening 130 is formed in a bottom floor area 132 of the space 128. The opening 130 will generally have a movable flap 134 hinged to the opening 130. The flap 134 may be moved to open the space 128 to allow access to the interior of the space 128 and closed to prevent access to the interior of the space 128.

The flap 134 is generally opened to remove money from the space 128 of the chamber display 104 or to insert money into the space 128 of the chamber display 104. As shown in the Figures, once the flap 134 is opened to remove the money, the mechanisms used to move the money through the tube display 102 will cause the money to flow out of the opening 130 down a chute 136 to a secure location such as a secure room, a vault, or the like. When the flap 134 is opened to insert money, once the money is placed in the space 128, the flap 134 is closed. The money may then flow through the space 128. As shown in the Figures, in accordance with one embodiment, once the flap 134 is closed, a continuous loop is formed in the space 128 of the chamber display 104. This will allow the money to continuously flow through around the space 128 until the money is removed or the mechanism to move the money is stopped.

In order for the money to move through the space 128 some type of flow mechanism needs to be used. In accordance with one embodiment of the present invention, one or more blowers 136 are installed in the bottom floor area 132 of the space 128 of the chamber display 104. As shown in the Figures, one of more fan openings 138 is formed in the bottom floor area 132 of the space 128. The blower 136 is then attached to the opening 136 to form a tight seal around the opening 138. The blower(s) 136 will provide enough wind velocity to continuously move the money around the space 128. The number of blowers 136 and the horsepower of the blowers 136 will depend on the size and shape of the space 128 of the chamber display 104. Louvers 140 may be placed over the blowers 136. The louvers 140 direct air flow from the blowers 136 so that the money will continuously swirl in the space 128 until the blowers 136 stop.

While embodiments of the disclosure have been described in terms of various specific embodiments, those skilled in the art will recognize that the embodiments of the disclosure can be practiced with modifications within the spirit and scope of the claims.

What is claimed is:

1. A money display vault comprising:

at least one of a transparent tube display and a transparent chamber display to allow cash reserves of an establishment to be displayed; and a device coupled to the at least one of a transparent tube display and a transparent chamber display to move the money around the at least one of a transparent tube display and a transparent chamber display;

wherein the transparent chamber display comprises:

a hollow transparent enclosure having an outer wall and inner wall formed inside the perimeter of the outer wall to form a space where cash reserves is displayed; and a door hingedly coupled to the hollow transparent enclosure to allow a person to go into an interior section of the hollow transparent enclosure, wherein the door has an outer door wall and an inner door wall aligned with the outer wall and inner wall of the enclosure when the door is closed.

2. A money display vault in accordance with claim 1 wherein the at least one of a transparent tube display and the transparent chamber display are formed of a bullet/shatter proof clear material.

3. A money display vault in accordance with claim 1 wherein the transparent tube display comprises:

a plurality of transparent tubular members fit together to form a pathway around the establishment;

at least one opening formed in the transparent tube display to allow access to an interior of the transparent tube display to insert and remove money from the transparent tube display; and a tube blowing mechanism coupled to the transparent tube display to move the money through the transparent tube display.

4. A money display vault in accordance with claim 3 wherein the tube blowing mechanism comprises:

at least one tube blower opening formed in the transparent tube display; and at least one fan device coupled to the at least one tube blower opening.

5. A money display vault in accordance with claim 3 wherein the plurality of transparent tubular members fit together to form a continuous loop pathway around the establishment.

6. A money display vault in accordance with claim 1 wherein the transparent chamber display further comprises:

at least one chamber opening formed in the hollow transparent enclosure to allow access to an interior of the transparent tube display to insert and remove money from the hollow transparent enclosure; and a chamber blowing mechanism coupled to the hollow transparent enclosure to move the money within the hollow transparent enclosure.

7. A money display vault in accordance with claim 6 wherein the chamber blowing mechanism at least one chamber blower opening formed in a bottom section of the enclosure; and at least one chamber fan device coupled to the at least one chamber blower opening.

8. A money display vault in accordance with claim 6 wherein the at least one chamber opening and the chamber blowing mechanism are positioned in the space between the outer wall and the inner wall.

9. A money display vault in accordance with claim 6 further comprising louvers coupled to the chamber blowing mechanism.

10. A money display vault comprising:

a transparent tube display to allow cash reserves of an establishment to be displayed to the public, yet remained secured from possible theft;

a transparent chamber display to allow cash reserves of an establishment to be displayed to the public, yet remained secured from possible theft; and a device to move the money around the transparent tube display and the transparent chamber display;

wherein the transparent chamber display comprises a hollow transparent enclosure comprising:

an outer wall formed along an outer perimeter of the enclosure; and an inner wall formed inside a perimeter of the outer wall to form a space between the outer wall and the inner wall, wherein the space is a money flow;

wherein the door has an outer door wall and an inner door wall aligned with the outer wall and inner wall of the enclosure when the door is closed;

wherein the transparent tube display and the transparent chamber display are formed of a bullet/shatter proof clear material.

11. A money display vault in accordance with claim 10 wherein the transparent tube display comprises:

a plurality of transparent tubular members fit together to form a pathway around the establishment;

at least one tube opening formed in the transparent tube display to allow access to an interior of the transparent tube display to insert and remove money from the transparent tube display; and a tube blowing mechanism coupled to the transparent tube display to move the money through the transparent tube display.

12. A money display vault in accordance with claim 10 wherein the tube blowing mechanism comprises:

at least one tube fan opening formed in the transparent tube display; and at least one tube fan coupled to the at least one tube fan opening.

13. A money display vault in accordance with claim 11 wherein the plurality of transparent tubular members fit together to form a continuous loop pathway around the establishment.

14. A money display vault in accordance with claim 10 wherein the transparent chamber display further comprises:

at least one chamber opening formed in the hollow transparent enclosure to allow access to an interior of the transparent tube display to insert and remove money from the hollow transparent enclosure; and a chamber blowing mechanism coupled to the hollow transparent enclosure to move the money within the hollow transparent enclosure.

15. A money display vault in accordance with claim 10 wherein the chamber blowing mechanism at least one chamber blower opening formed in a bottom section of the enclosure; and at least one chamber fan device coupled to the at least one chamber blower opening.

16. A money display vault in accordance with claim 10 wherein the hollow transparent enclosure comprises:

an outer wall formed along an outer perimeter of the enclosure;

an inner wall formed inside a perimeter of the outer wall to form a space between the outer wall and the inner wall, wherein the space is a money flow;

wherein the door has an outer door wall and an inner door wall aligned with the outer wall and inner wall of the enclosure when the door is closed.

17. A money display vault in accordance with claim 16 wherein the at least one chamber opening and the chamber blowing mechanism are positioned in the space between the outer wall and the inner wall.

18. A money display vault comprising:

a transparent tube display to allow cash reserves of an establishment to be displayed;

a transparent chamber display to allow the cash reserves of an establishment to be displayed; and a device to move the cash reserves around the transparent tube display and the transparent chamber display;

wherein the transparent chamber display comprises:

a hollow transparent enclosure; and a door hingedly coupled to the hollow transparent enclosure to allow a person to go into an interior section of the hollow transparent enclosure;

wherein the hollow transparent enclosure comprises:

an outer wall formed along an outer perimeter of the enclosure;

an inner wall formed inside a perimeter of the outer wall to form a space between the outer wall and the inner wall, wherein the space is where the cash reserve is displayed;

wherein the door has an outer door wall and an inner door wall aligned with the outer wall and inner wall of the enclosure when the door is closed.

19. A money display vault in accordance with claim 10 wherein the transparent tube display comprises:

a plurality of transparent tubular members fit together to form a pathway around the establishment;

at least one tube opening formed in the transparent tube display to allow access to an interior of the transparent tube display to insert and remove money from the transparent tube display; and a tube blowing mechanism coupled to the transparent tube display to move the money through the transparent tube display.

20. A money display vault in accordance with claim 18 wherein the transparent chamber display further comprises:

at least one chamber opening formed in the hollow transparent enclosure to allow access to an interior of the transparent tube display to insert and remove money from the hollow transparent enclosure; and a chamber blowing mechanism coupled to the hollow transparent enclosure to move the money within the hollow transparent enclosure.

* * * * *